US005247895A

United States Patent [19]

Plümecke et al.

[11] Patent Number: 5,247,895

[45] Date of Patent: Sep. 28, 1993

[54] METHOD AND APPARATUS FOR GUIDING A TORPEDO

[75] Inventors: Gerrit Plümecke; Rolf Sauerland, both of Bremen, Fed. Rep. of Germany

[73] Assignee: Atlas Elektronik GmbH, Bremen, Fed. Rep. of Germany

[21] Appl. No.: 451,715

[22] Filed: Dec. 7, 1982

[30] Foreign Application Priority Data

Dec. 9, 1981 [DE] Fed. Rep. of Germany ..... 3148734

[51] Int. Cl.[5] ..... F42B 19/01

[52] U.S. Cl. ..... 114/21.3

[58] Field of Search ..... 114/20 R, 21 R, 21 A, 114/23

[56] References Cited

U.S. PATENT DOCUMENTS 1,861,215 5/1932 Hammond, Jr. ..... 114/23
2,409,632 10/1946 King ..... 114/21 A
3,049,087 8/1962 Conley et al. ..... 114/23
3,721,952 3/1973 Strapp ..... 114/23

FOREIGN PATENT DOCUMENTS 887926 8/1953 Fed. Rep. of Germany .
2059155 10/1971 Fed. Rep. of Germany .
977892 4/1972 Fed. Rep. of Germany .
2417080 10/1975 Fed. Rep. of Germany .
2525569 12/1978 Fed. Rep. of Germany .
2151348 3/1981 Fed. Rep. of Germany .

*Primary Examiner*—Charles T. Jordan
*Attorney, Agent, or Firm*—Spencer, Frank & Schneider

[57] ABSTRACT

Method and apparatus for guiding an acoustic torpedo toward a ship selected as target which, as a defence against torpedoes drags noise generating decoys (so-called disturbance generators) wherein the torpedo is acoustically guided toward the noise source having the greatest noise level for the torpedo. As the torpedo approaches the noise source a check is made for the presence of a wake, and after detection of a wake in the immediate vicinity of the noise source during passage of the torpedo underneath the noise source, a check is made for the minimum expanse of the noise source in the vertical and travelling direction of the torpedo. The torpedo is set to search for a further noise source if no wake is detected or if a wake is detected in the vicinity of the noise source but a predetermined minimum expanse for the noise source is not detected.

13 Claims, 4 Drawing Sheets

METHOD AND APPARATUS FOR GUIDING A TORPEDO

BACKGROUND OF THE INVENTION

The present invention relates to a method for guiding an acoustic torpedo toward a ship which has been selected as a target and which is dragging one or more noise generating decoys, i.e. so-called disturbance generators, as a defense against torpedoes, and to an apparatus for implementing this method.

It is known to use acoustic torpedoes for the automatic search and attack of ships. Such acoustic torpedoes are equipped with a sound-detecting system which is highly sensitive in the forward direction. This sound-detecting system is able to detect the sound radiation of a moving ship and utilize it to guide the torpedo.

To defend the ship against automatically guided acoustic torpedoes it is known to frequently change course and to use noise generating decoys or disturbance generators. These disturbance generators are dragged behind the ship, with the length of the drag line and the moment of use of the disturbance generators being variable. The disturbance generators are provided with guide surfaces or the like so that they can be used with different drag angles and so that they may also be outside of the actual path of the ship. The disturbance generators produce a noise which has a much greater volume than the moving ship. Consequently the torpedo is caused to approach and attack the disturbance generator rather than the ship since the sound detection system of the torpedo always directs the torpedo toward the strongest or loudest noise source.

Several methods are known which overcome this drawback and which make it possible, even in the presence of a strong noise source, to detect further noise sources. For example, Federal Republic of Germany Offenlegungsschrift (Laid-open Application No. 2,059,155, published Oct. 7, 1971) discloses a method which detects a plurality of noise sources on the basis of significantly different frequencies and permits the indication of the direction of the noise sources by means of frequency selection. However, this method requires that every noise source have its own specific frequency.

This last requirement is not necessary with the method disclosed in Federal of Germany Offenlegungsschrift No. 2,417,0800, published Oct. 9, 1975. With that latter method, it is possible to determine and indicate the direction of a plurality of noise sources even if these noise sources have the same frequency spectra. The individual noise sources are determined with the aid of a gradient ranging system in order to form and pivot cardioid characteristics. However, such a process is rather complicated and time consuming since every noise source must have its own cardioid characteristic and the individual cardioid characteristics must be aligned one after the other with the individual noise sources. Such a method cannot be used to determine a disturbance generator during a torpedo attack since an attacked ship is able to defend itself with a plurality of disturbance generators which would all have to be detected one after the other.

A further method for differentiating between a plurality of noise sources is disclosed in Federal Republic of Germany Offenlegungsschrift No. 2,525,569, published Dec. 21, 1978. This method utilizes the differences between the sound spectrum of a disturbance generator and that of a ship and the fact that a ship gives off stochastic or random noise components in addition to periodic noise components, while a disturbance generator emits only periodic noise. A correlative testing method is used to evaluate the different noises.

Some of the above-mentioned methods are rather complicated and some require certain conditions in order to operate properly.

SUMMARY OF THE INVENTION

It is the object of the present invention to provide a method for guiding an acoustic torpedo with which the torpedo can reach its target without substantial detours in spite of the enemy's use of disturbance generators.

The above object is broadly achieved according to the present invention by a method for guiding an acoustic torpedo toward a ship selected as target which, as a defence against torpedoes may be dragging noise generating decoys (so-called disturbance generators) which method comprises the steps of: acoustically guiding the torpedo toward the noise source having the greatest noise level for the torpedo; checking for the presence of a wake upon approach of the torpedo to the noise source; after detection of a wake in the immediate vicinity of the noise source during passage of the torpedo underneath the noise source, checking the noise source for a minimum expanse in the vertical and travelling direction of the torpedo; and setting the torpedo to search for a further noise source if no wake is detected or if a wake is detected in the immediate vicinity of the noise source but the minimum expanse is not detected.

In contrast to prior art methods which intend to avoid the travel of a torpedo toward disturbance generators, the noise generation of the disturbance generators is utilized to direct the torpedo from a far distance toward a disturbance generator, i.e. toward the noise source which is strongest, i.e. has the greatest noise level, for the torpedo sound detection system, and thus to bring the torpedo into a favorable rearward torpedo attack position with respect to the target when it reaches the vicinity of the target. To determine whether the approached noise source is the target or a disturbance generator, the wake generated by the target is utilized When the torpedo approaches the target from the rear, it must travel in the wake until it reaches the target. If the approached noise source is not in the wake, it is a disturbance generator and will not be attacked. However, if the noise source is in the wake, it must be tested for a minimum expanse and can be detected as the target due to its longitudinal expanse and its draft.

In order to detect a wake and to distinguish between a target and a disturbance generator, the torpedo transmits sound pulses toward the surface of the water and reflected echo signals are evaluated for the differentiation.

Received echo signals are distinguished according to their travel times. Due to the movement of the sea, echo signals reflected from the surface of the water have different travel times, and on the average they indicate the draft of the torpedo. Echo signals reflected from the bottom of the target can be recognized by their essentially constant travel times which indicate a distance less than the distance from the surface of the water. On the other hand, echo signals reflected by the wake of a ship have very great differences in travel time since the echo signals are reflected by air bubbles which are disposed between the torpedo and the surface of the water and whose distances from the torpedo vary considerably. Consequently, from the reflected echo signals, a presence of a wake can be detected by the receipt of a predetermined number of successive echo signals from greatly divergent distances. While the minimum expanse of a noise source which is a target can be detected when a predetermined number of successive echo signals from approximately the same and given distance is exceeded.

It is impossible to detect a disturbance generator from an evaluation of the travel times of echo signals since the disturbance generators have only little draft and their echoes disappear in the echoes from the surface of the water. However, such a differentiation is not needed at all for proper operation of the method according to the invention to guide the torpedo toward the target because the torpedo will attack only if,after the receipt of echo signals from the wake, echo signals are subsequently received from the bottom of the target.

A circuit arrangement for determining whether echo signals were reflected from the wake or from a ship is disclosed, for example, in German Patent No. 2,151,348, issued Mar. 12, 1981.

According to a further advantageous feature of the method according to the invention, the torpedo continuously ranges toward the noise source while it is in its approach. From the rangings and with reference to a path curve given to the torpedo when it was fired, a course is determined for the noise source, and thus an approximate course for the target. This determined course indicates the direction for the search for a further noise source, which search is terminated upon the acoustic detection of further noise sources.

Each torpedo is given a path curve along which it is to approach the target. Known curves are, for example, the dogleg curve, the squint angle curve, and a path curve called the collision curve.

The course of the disturbance generator is not always identical with that of the target dragging it since noise generators may temporarily have a different course than the target due to the provision of guide surfaces or the like. However, over a longer period of time, the disturbance generator does follow the course of the target so that an approximate course of the target can be determined.

Methods for determining the course of a target, by way of ranging are known. For example, German Patent No. 887,926, issued Aug. 27, 1963 discloses a method for determining the course and speed of the target in question from ranging angles of several ranging sequences and a consideration of the time differences in the rangings if the course and speed of the ranger remain constant.

Methods for seeking noise sources by means of an acoustical torpedo are also known. For example, German Patent No. 977,892, issued Apr. 6, 1972 discloses a combination of search semicircles which are to follow one another in opposite directions if the torpedo no longer detects the target with its sound detection system.

To make such a search in a given direction, according to a further advantageous feature of the method of the invention, the received echo or ranging signals are evaluated during the approach of the torpedo toward a noise source as to whether during this time echo signals were received from the wake, i.e. whether the torpedo is crossing the course of the target or has already crossed it. If this is the case, the search will involve turning the torpedo in the direction toward the target until the sound detection system again detects a noise source and directs the torpedo toward this source.

If the sound detection system directs the torpedo toward a further sound source after a search run, then, according to an advantageous further feature of the invention,the received echo signals are evaluated to determine whether, during the approach to the further sound source, echo signals were received from the target wake and whether these wake echo signals then suddenly cease, i.e. the torpedo leaves the wake. In that case, the guidance of the torpedo by the sound detection system is interrupted and replaced by forced guidance of the torpedo into the direction toward the target until echo signals are again received from the wake. Then the guidance by way of the sound detection system is reestablished and the torpedo is directed toward a further noise source as long as echoes are received from the wake.

Finally, according to a still further advantageous feature of the method according to the invention, in order to guide the torpedo back into the wake, the torpedo emits sound pulses, which are directed obliquely toward the surface of the water, from both sides of the torpedo, and echo signals received from the two directions of sound are separately evaluated. Upon the cessation of echo signals from the wake in one of the two directions, the torpedo is turned by means of forced guidance to the side of the torpedo from which echo signals from the wake are still being received.

According to the preferred embodiment of the apparatus according to the invention for implementing the above-described method, the acoustic torpedo, includes, in a conventional manner, a guidance device which is controllable by means of a sound detection system, and further includes: a level or amplitude measuring stage which is connected to the receiver output of the sound detection system and which emits a drop-in-level signal at its output as long as the signals received from the sound detection system do not exceed a given threshold value; a detection device which is designed to detect a wake and to detect a vertical and horizontal minimum expanse of a noise source, and which includes an identification circuit connected at its control input with the output of the amplitude measuring stage and designed such that it produces a firing order at a first of its two outputs whenever, before the occurrence of the drop-in-level signal, a wake has been detected and, after the occurrence of the drop-in-level signal, a minimum expanse of the noise source has been detected, and otherwise produces a setting order at the second of its two outputs for the duration of the drop-in-level signal; and a search circuit responsive to a setting signal at the second output of the identification circuit for causing the torpedo to commence a search run. The level measuring stage connected with the sound detection system emits the drop-in-level signal when the signals received from the sound detection system indicate a sudden drop in level as occurs when the torpedo moves underneath a noise source, since then the noise source is disposed above the torpedo and thus no longer in the range of the forward oriented sound detection system. The occurrence of the drop-in-level signal indicates a point at which wake and minimum extent can be determined.

According to an advantageous feature of the apparatus according to the invention, the detection device includes an echo sounder which ranges toward the surface of the water and whose echo receiver is connected with an echo memory connected to the signal input of the indentification circuit. By evaluating received echo signals, the wake and the minimum extent of the noise source can be detected.

According to a further advantageous feature of the apparatus according to the invention, the setting instruction at the second output of the identification circuit is fed to the search circuit via a guidance signal generator and the search circuit has its output connected with the guidance device for the torpedo.

For the direct guidance of the torpedo with the search circuit, an advantageous feature of the apparatus according to the invention provides that the search circuit includes a search course generator and a turning course generator whose inputs are connected to outputs of a guidance signal generator and whose outputs are connected to the output of the search circuit. To determine the direction in which a search or turn is to occur, a computer circuit is provided to detect the courses of the noise sources. The output of this computer circuit is connected to the control inputs of the search course generator and of the turning course generator.

According to a further advantageous feature of the apparatus according to the invention, the guidance signal generator includes a value detector which is connected with the echo memory and which, when it detects a value, emits a signal to a bistable multivibrator whose output is connected to an input of two logic stages. The other inputs of the logic stages are connected to the second output of the identification circuit while the outputs of the logic stages are connected with the inputs of the search course generator and the turning course generator. With this arrangement, the wake detector determines whether, during its approach toward the noise source, the torpedo has already moved underneath the wake and has thus crossed the path of the target. If this is the case, the torpedo must turn around to find the target. For this purpose, the turning course generator is actuated by the set multivibrator stage. The search course generator is actuated by the unset multivibrator stage, i.e. when the torpedo has not yet reached the wake and the search must continue.

After the torpedo has passed underneath the first noise source, it should approach other noise sources until it reaches the wake and must then approach the target in the wake. For the corresponding guidance of the torpedo in the wake, the guidance signal generator, according to a further advantageous feature of the apparatus according to the invention, includes a guidance switch whose output stages are switched at a certain point in time at which, after a drop in the drop-in-level signal, the wake signal drops for the first time, i.e. the torpedo has passed underneath a noise source and its sound detection system causes it to approach a further noise source and to thus leave the wake. After switching, the guidance switch emits a signal at its second output. This output state of the guidance switch remains the same after switching and is independent of other changes at its inputs.

As long as the torpedo is in the wake, it is guided by its sound detection system. As soon as it leaves the wake, the torpedo sound detection system is separated from the guidance device and the torpedo is guided by the turning course generator. A guidance gating circuit is provided for, this purpose. It is connected between the guidance device and the guidance output of the sound detection system and its gating input is connected with a third output of the guidance signal generator.

As soon as the guidance switch has switched, the guidance gating circuit is no longer always opened by a gating signal from the first output of the guidance switch but only upon detection of a wake.

Search instructions from the identification circuit must no longer become effective for guidance as soon as the sound detection system guides the torpedo out of the wake. This is accomplished by a blocking logic circuit connected between the identification circuit and the logic stages and with the second output of the guidance switch.

Finally, according to still a further advantageous feature of the apparatus according to the invention, the detection device includes a further echo sounder in order to guide the torpedo in the wake. Transmitted pulses of the two echo sounders are emitted obliquely against the surface of the water on both sides of the torpedo. One echo receiver is disposed on the port side of the torpedo and one echo receiver is disposed on the starboard side of the torpedo. The one echo receiver is connected with the echo memory, the other echo receiver is connected with a temporary memory. The echo signals from both echo receivers are used to guide the torpedo only if a course signal appears at a second output of the computer circuit and thus indicates that the torpedo essentially follows the course of the target.

By using the two echo receivers it is accomplished that the torpedo, when it leaves the wake, is immediately turned toward that side at which echo signals from the wake are still being received, i.e. at which side the torpedo is still disposed in the wake.

One advantage of the guidance method according to the invention for an acoustic torpedo is that the torpedo is guided toward a selected target without the disturbance generators dragged by the target being able to interfere with this guidance. A firing order is initiated only if during approach toward a noise source, this noise source has been detected as being in the wake by means of echo signals having very different travel times and, immediately after the echo signals from the wake, echo signals of constant travel time indicate the target.

A particular advantage of the method according to the invention is that the torpedo, after firing, reaches the target on the shortest possible path since the noise of the disturbance generators is utilized to bring the torpedo into the vicinity of the target. Thereafter, the wake of the target is utilized to bring the torpedo, following in the wake, into a rearward attack position with respect to the target. It is further assured with the guidance method according to the invention, that disturbance generators cannot lure the torpedo out of the wake and thus force it to move on detours in its travel from its attack position toward the target. This is accomplished in that the torpedo is initially guided by its sound detection system to approach and travel underneath at least one noise source, which could possibly be the target itself, but as soon as the torpedo, after passing underneath the noise source, reaches the wake or is disposed in the wake, respectively, it is guided by the sound detection system only if echo signals are received from the wake. When the torpedo leaves the wake, guidance from the sound detection system is interrupted, the torpedo is forced to turn in the direction toward the target until it is back in the wake and then the sound detection system again takes over the guidance of the torpedo. Wake detection on both the port and starboard sides of the torpedo is of particular advantage because the forced guidance to turn the torpedo back into the wake can be actuated already if the wake is lost only on one side of the torpedo.

DETAILED DESCRIPTION OF THE PREFERRED EMBODIMENT

Figure 1:
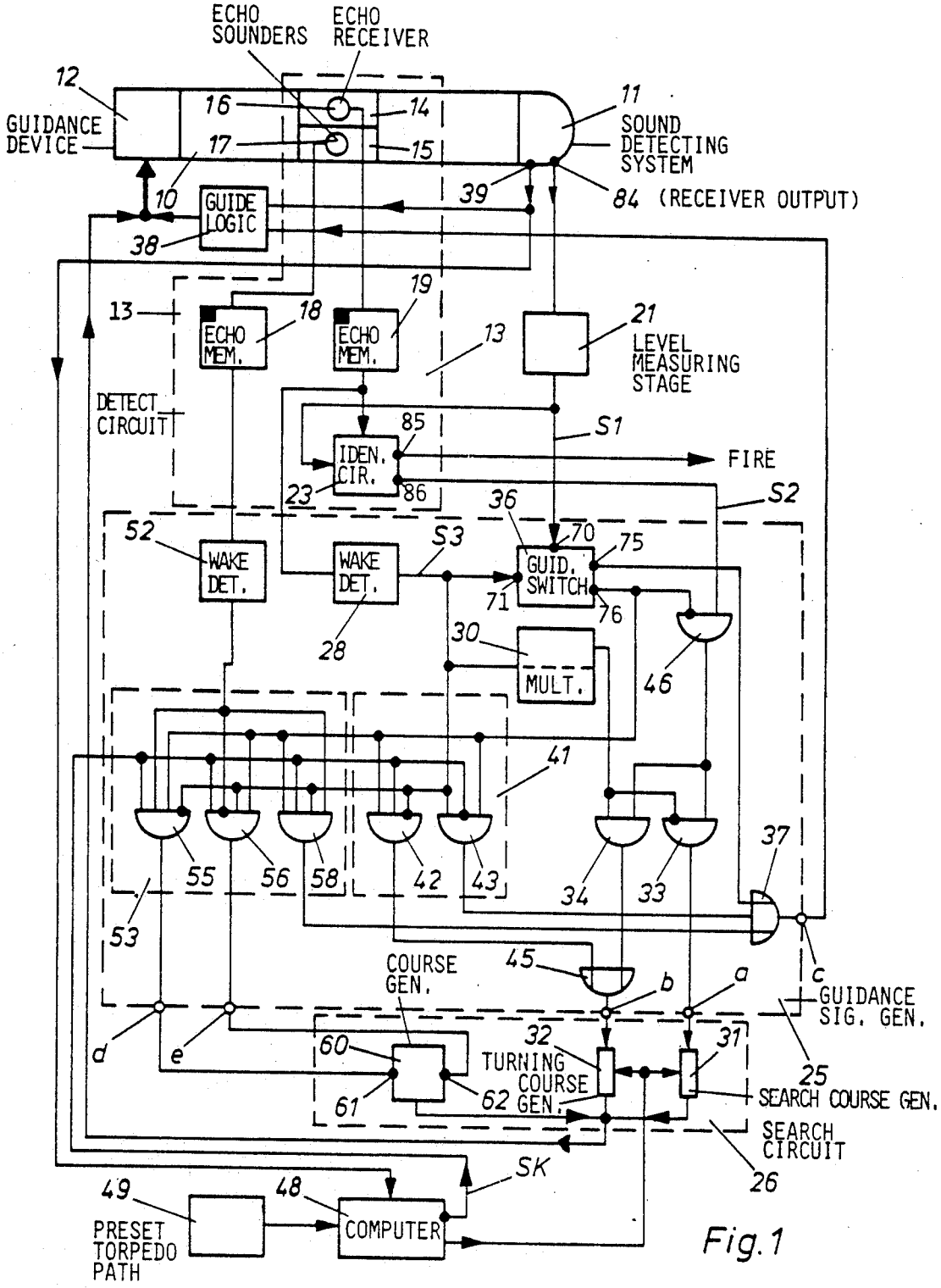
FIG. 1 is a block circuit diagram of a preferred embodiment of the apparatus according to the invention for carrying out the method of the invention.

As shown in FIG. 1, a torpedo 10 includes a conventional passive sound detection system 11 and a conventional guidance device 12 which is normally controlled by a guidance signal from the sound detection system 11. The torpedo 10 further includes a detection circuit 13 for detecting a wake and a predetermined horizontal and vertical minimum expanse of a noise source approached by the torpedo 10 as will be explained in further detail with respect to FIG. 5. The detection circuit 13 includes two active or echo sounders 14, 15 whose transmitters (not shown) emit sound pulses obliquely upwardly toward the surface of the water and symmetrically with respect to the longitudinal axis of the torpedo 10. Each echo sounder 14, 15 includes an echo receiver 16, 17, respectively. The echo receiver 16 attached on the port side of the torpedo 10 is connected with a temporary echo memory 18, while the echo receiver 17 attached to the starboard side of the torpedo is connected with an echo memory 19. The memories 18 and 19 store the received echo signals from the echo or ranging receivers 17 and 16, respectively.

The sound detection system 11 includes a receiver output 84 which is connected with a level or an amplitude measuring stage 21. The level measuring stage 21 emits a drop-in-level signal S1 if signals received from the sound detection system exhibit a sudden drop in level as is the case when the torpedo 10 passes underneath a noise source. The drop-in-level signal S1 remains present at the level measuring stage 21 as long as the received signals from the sound detection system 11 do not yet again exceed a given threshold value.

In order to evaluate the echo signals stored in the echo memory 19 with respect to wake echoes, i.e. echoes having very different travel times, and target or ship echoes, i.e. echoes having a constant travel time, an identification circuit 23 is provided which has its signal input connected with the echo memory 19 and its control input connected with the output of the level measuring stage 21. The identification circuit 23 emits a firing order at its first output 85 if, before the occurrence of the drop-in-level signal S1, echo signals from the wake are recorded in echo memory 19 and, after the occurrence of the drop-in-level signal S1, echo signals are also stored from the bottom of a ship. If this is not the case, i.e. if no echo signals are recorded in echo memory 19 from the wake and/or from the bottom of a ship, the identification circuit 23 emits a setting instruction at its second output 86 as long as the drop-in-level signal S1 is present.

Connected to the second output 86 of the identification circuit 23, via a guidance signal generator 25, is a search circuit 26. The search circuit 26 includes a search course generator 31 and turning course generator 32 whose inputs are connected, respectively, with a first and a second output a and b of the guidance signal generator 25 and whose outputs are connected with the guidance device 12 for the torpedo 10.

In order to determine the direction in which a search course or a turning course is to be taken, the torpedo 10 includes a computer circuit 48 which determines an approximate course for the ship. The input of the computer circuit 48 has one input to which is connected the output of a torpedo path signal generator 49, which provides the desired path of the torpedo 10 toward the target as determined at the time of firing of the torpedo toward the target. The computer circuit 48 has a further input connected with the guidance output 39 of the sound detection system 11. The computer circuit 48 may determine the course of an approaching noise source, for example, according to the method disclosed in German Patent No. 887,926, by ranging toward the noise source which then provides an approximate course for the target. One output of the computer circuit 48 is connected with the control inputs of the search course generator 31 and of the turning course generator 32 and guides a turning course or a search course, respectively, into the direction toward the target.

In order to actuate the search course generator 31 or the turning course generator 32, respectively, by means of the setting instruction S2 produced at the output 86 of the identification circuit 23, the guidance signal generator 25 includes a wake detector 28, which continuously evaluates the echo signals stored in memory 19 for the presence of a wake, and two logic stages 33, 34 which are AND stages or gates. The output of the first logic stage 33 is connected, via the first output a of the guidance signal generator 25, with the input of the search course generator 31, and the output of the second logic stage 34 is connected, via the second output b of the guidance signal generator 25, with the input of the turning course generator 32.

The wake detector 28 has its input connected with the echo memory 19 and its output with a bistable multivibrator stage 30. The multivibrator stage 30 is set by the wake detector 28 as soon as the wake detector 28 emits a wake signal S3 indicating that echo signals from a wake are stored in the echo memory 19. When the multivibrator stage 30 is set, the setting order S2 from the identification circuit 23 is given, via logic stage 34, to the turning course generator 32. Alternatively, if the multivibrator stage 30 is not set, the setting order S2 is fed, via logic stage 33, to the search course generator 31. In order to effect this switching, the two logic stages 33, 34 are connected with the second output 86 of the identification circuit 23 via a gate 46 to be explained below. The respective other inputs of the two logic stages 33 and 34 are connected with one output of the multivibrator stage 30, with the input of the first logic stage 33 being negated.

The guidance signal generator 25 includes a guidance switch 36 which effects forced guidance of the torpedo 10 back into the wake if, after passing underneath a noise source, the torpedo 10 reaches the wake and leaves it again under the guidance of the sound detection system 11. At this moment, the forced guidance back into the wake begins. A guidance logic circuit 38 is provided to permit this forced guidance. The guidance logic circuit 38 is connected between the guidance output 39 of the sound detection system 11 and the guidance device 12 of the torpedo 10 and its gating input is connected with a third output c of the guidance signal generator 25.

A logic circuit 41 is provided to actuate a gating signal for the guidance logic circuit 38 or to actuate forced guidance by means of the turning course generator 32 via an OR gate 45.

The guidance switch 36 has two inputs 70 and 71 connected with the output of the amplitude measuring stage 21 and with the output of the wake detector 28, respectively. The guidance switch 36 has two outputs 75 and 76 of which only one at a time emits a signal. The output state of the guidance switch 36 is changed at a moment at which, after a drop in the drop-in-level signal S1, the wake signal S3 drops for the first time at the output of the wake detector 28, i.e. the torpedo 10 leaves the wake (for the detailed operation of the guide switch 36, see FIGS. 2 to 4 and the description below). The first output 75 of the guidance switch 26 is connected, via an OR gate 37, with the third output c of the guidance signal generator 25 and emits a gating signal for the guidance logic 38 and connects the sound detection system 11 with the guidance device 12 of the torpedo 10 as long as the guidance switch 36 has not yet switched. The second output 76 of the guidance switch 36 is connected with the logic circuit 41, and the signal at the second output 75 of the guidance switch 36, which appears after the guidance switch has switched, is fed, via logic circuit 41, either to another input of OR gate 37 connected ahead of the third output c of the guidance signal generator 25 or, via the second OR logic 45 and the second output b of the guidance signal generator 25, to the input of the turning course generator 32.

The logic circuit 41 includes two AND gates 42, 43, which both have one input connected to the second output 76 of the guidance switch 36 and both have another input, which is a negated input for the AND gate 42, connected with the output of the wake detector 28. This negated input for AND gate 42 causes AND gate 42 to open when the torpedo is not in the wake and thus switches the signal at the second output 76 of the guidance switch 36 to the turning course generator 32. If the torpedo is in the wake, AND gate 42 with its negated input is blocked and AND gate 43 is open so that the signal at the second output 76 of the guidance switch 36 is switched to the OR gate 37 ahead of the third output c of the guidance signal generator 25 as a gating signal for the guidance logic circuit 38.

Since search runs are no longer necessary after the torpedo 10 enters the wake, the identification circuit 23 then serves only to check for the real target; the setting order S2 must no longer actuate the search circuit 26. This is accomplished by a blocking logic circuit 46 which is connected between the second output 86 of the identification circuit 23 and the logic stages 33, 34, which blocking logic 46 blocks the signal at the second output 76 of the guidance switch 36. The blocking logic 46 is an AND gate having a negated input connected to output 76 of guidance switch 36 and its other input connected to one input of each of the AND gates 33 and 34.

The torpedo 10 is guided with both its echo sounders 14 and 15 only in exceptional cases, i.e. when the torpedo follows in the wake essentially along the course of the ship determined by the computer circuit 48, i.e. the angle between the course of the ship and that of the torpedo is sufficiently small. Such a fact is indicated by a course signal Sk which in the stated case appears at a second output of the computer circuit 48.

For this type guidance, the search circuit 26 includes a further course generator 60 having two inputs 61, 62 through which it is possible to cause the torpedo 10 to turn toward port or starboard, respectively. Its starboard control input 61 is connected with a fourth output d of the guidance signal generator 25. The output of the course generator 60 is connected, together with the outputs of the turning and search course generators 31 and 32, to the guidance device 12 for the torpedo 10.

In order to evaluate the echo signals from the starboard echo sounder 17, the guidance signal generator 25 includes a second wake detector 52 which is connected in series with the temporary memory 18, and a logic linkage circuit 53 which has inputs connected with the outputs of the two wake detectors 28 and 52, as well as with the second output 76 of the guidance switch 36 and with the second output of computer circuit 48. The logic linkage circuit 53 includes an AND stage 58 having four inputs which are connected directly with the two wake detectors 28, 52, with the second output 76 of the guidance switch 36 and with the second output of the computer circuit 48. AND stage 58 emits a gating signal, via OR gate 37 at the third output c of the guidance signal generator 25, to the guidance logic 38 whenever all its input signals are present. In order to actuate the two inputs of the course generator 60, the logic linkage circuit 53 includes two further AND logic stages or gates 55, 56 each having four inputs including a first input which is connected respectively with the output of the wake detector 52 or with the output of the wake detector 28. Each AND gate 55, 56 has respective further inputs connected with the second output of the computer circuit 48 and with the second output 76 of the guidance switch 36. The fourth input of AND logic 55 is a negated or inverted input which is connected with the output of the first wake detector 28, while the fourth input of the second AND gate 56 is an inverted or negated input, which is connected with the output of the second wake detector 52. The output of AND gate 55 and the output of AND logic 56 are connected with the fourth output d and with the fifth output e, respectively, of the guidance signal generator 25. The negated inputs of the two AND gates 55, 56 cause the torpedo 10 to be actuated via the course generator 60 toward that side at which echo signals are still being received from the wake. This is done in such a manner that AND gate 55 emits a signal whenever the first wake detector 28, which is associated with the port echo receiver, does not emit a wake signal S3, while AND gate 56 emits a signal if the second wake detector 52, which is associated with the starboard echo sounder, receives no echo signals from the wake, and hence does not emit a wake signal S3.

The course signal Sk at the second output of the computer circuit 48 additionally actuates the logic circuit 41 to prevent emission of a gating signal or of a turning signal, respectively, as long as the course signal Sk is present at the second output of the computer circuit 48. For this purpose, both AND gates 42 and 43 each receive the course signal Sk at a further negated input to block the effect of the logic circuit 41.

Figure 2:
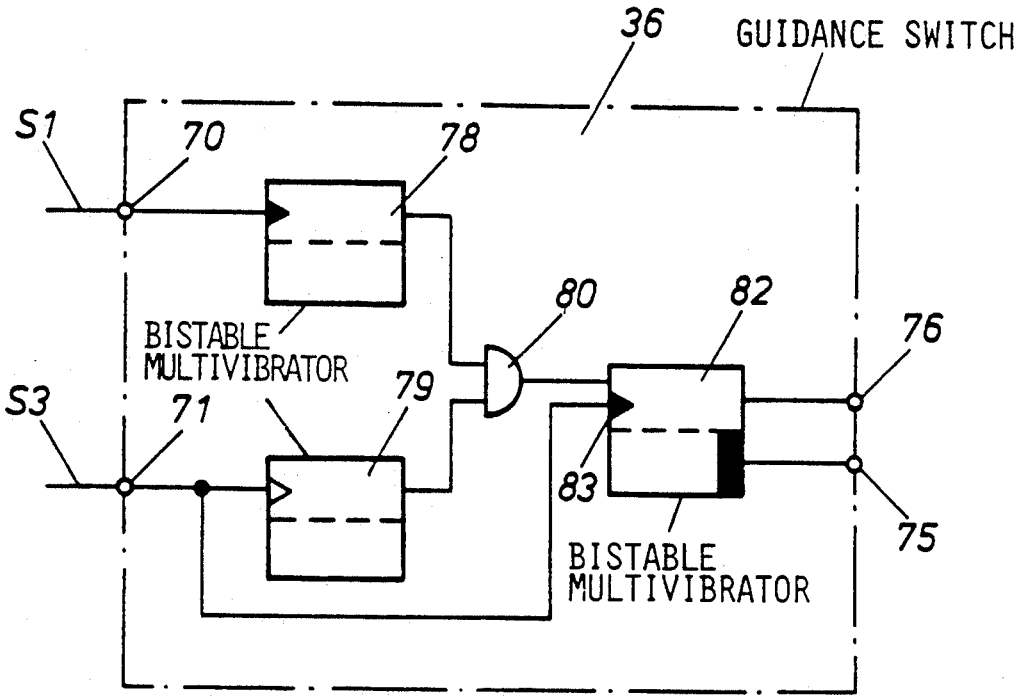
FIG. 2 is a block circuit diagram of a preferred embodiment of the guidance switch of FIG. 1.

FIG. 2 is a block circuit diagram of the guidance switch 36 of FIG. 1. At its two inputs 70, 71 there appear the drop-in-level signal S1 and the wake signal S3. Each input 70, 71 is connected to the respective dynamic setting input of a bistable multivibrator stage 78, 79. Multivibrator stage 78 is set, via its dynamic input, by a negative going edge of the drop-in-level signal S1 and multivibrator stage 79 is set by the positive going edge of the wake signal S3. Thus, as shown in FIGS. 3 and 4, multivibrator stage 78 is set at time t3 and multivibrator stage 79 is set at time t1 (FIG. 4) or at time t4 (FIG. 3).

An AND gate 80 is connected in series with the set outputs of both multivibrator stages 78 and 79 and the output of AND gate 80 is connected with an enabling input of a bistable multivibrator circuit 82. Thus, at the enabling input of multivibrator 82 an enabling signal appears no later than beginning at time t4 (FIGS. 3 and 4) at which the two multivibrator stages 78, 79 are certain to be set. Multivibrator circuit 82 is provided with a dynamic setting input 83 which is controlled by negative going edges of its input signal and is connected with the input 71 of the guidance switch 36. Multivibrator circuit 82 has two outputs which form the first or reset output 75 and the second or set output 76 of the guidance switch 36. The outputs 75 and 76 are inverted with respect to one another with the first output 75, when the multivibrator 82 is not set, having the logic value "L". At time t5, multivibrator circuit 82 is set by the trailing edge of the wake signal S3 and a signal appears at the second output 76 of guidance switch 36, and thus guidance switch 36 is switched.

Figure 3:
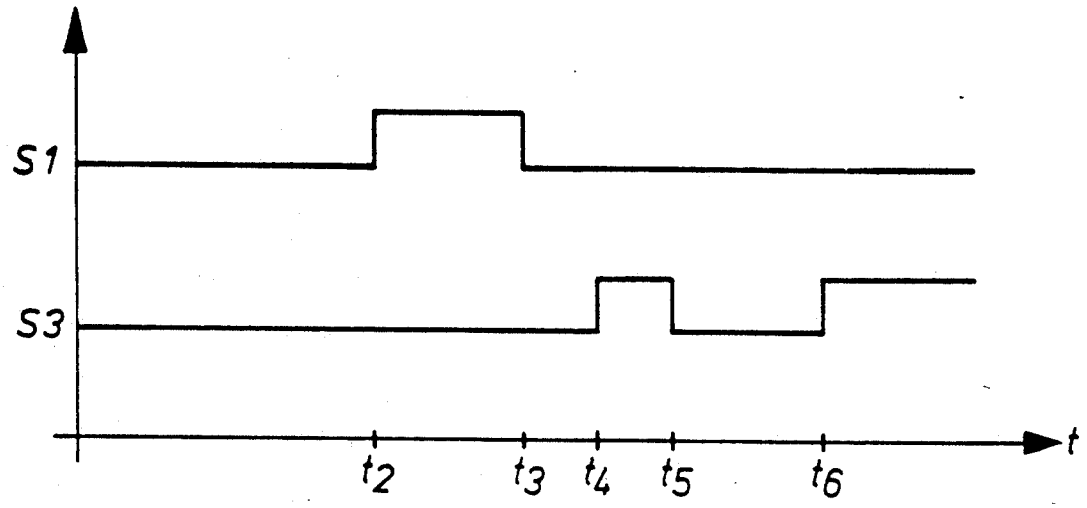
FIGS. 3 and 4 show signal curves at the input of the guidance switch of FIG. 2 upon approach to a noise source which is not in a target wake and which is in a target wake, respectively.
Figure 4:
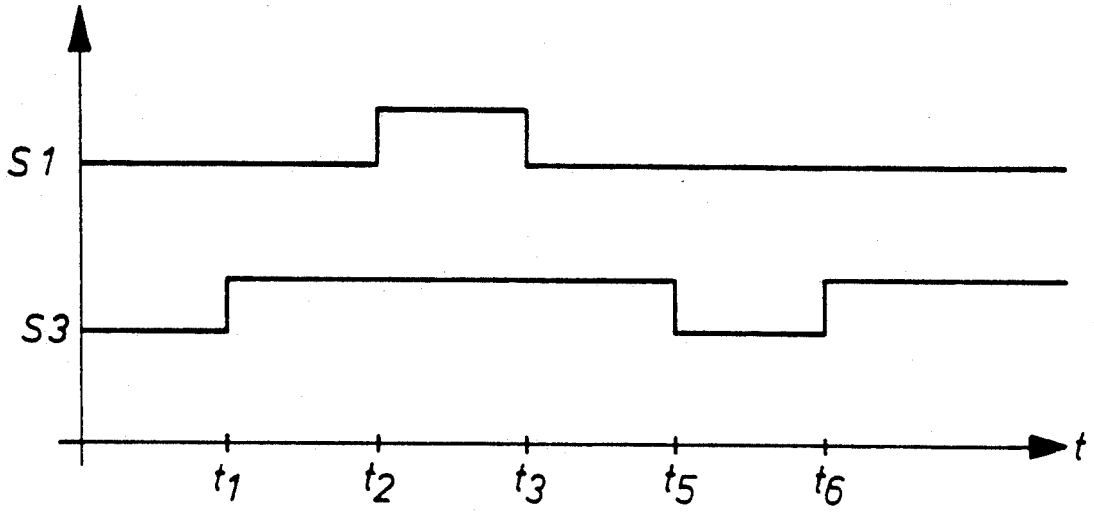

FIGS. 3 and 4 show examples for the drop-in-level signal S1 produced by the level measuring stage 21 and for the wake signal S3 produced by the wake detector 28 which are present as input signals at the inputs 70 and 71, respectively, of the guidance switch 36. The signals S1 and S2 are plotted as a function over time t. Depending on these signals, guidance instructions for the guidance device 12 of the torpedo 10 are actuated by the circuit of FIG. 1.

FIG. 3 shows signals which are generated by the circuits 21 and 28 when the torpedo 10 approaches a noise source, unless the noise source is in the wake. The drop-in-level signal S1 appears at time t2 as soon as the torpedo 10 passes underneath a noise source and the input signals of the sound detection system 11, which is sensitive only in the forward direction, indicate a sudden drop in level. The drop-in-level signal S1 is present until time t3 at which time the sound detection system 11 detects a further noise source. During time period t2–t3, the drop-in-level signal S1 actuates the identification circuit 23 which emits a setting order S2 at its output 86 for a search once it has been determined that the noise source under which the torpedo has passed, is a disturbance generator. In the described case such test is not needed since the noise source is not disposed in the wake, i.e. cannot be the target. Since no wake has been detected by time t2, the setting order S2 actuates the search course generator 31 via the gates 46 and 33. Beginning with time t3, the torpedo is again guided by its sound detection system 11.

The wake signal S3 appears for the first time at time t4, at which time the torpedo 10 has reached the wake, and remains as long as the torpedo remains in the wake, i.e. in this case until time t5 at which time the torpedo leaves the wake again. At time t5 the multivibrator circuit 82 (see FIG. 2) of the guidance switch 36 is set and the output states of the guidance switch 36 change. At this time, forced guidance of the torpedo 10 begins in that the guidance gating circuit 38 is blocked (no gating signal) and the turning course generator 32 is actuated to cause the torpedo 10 to be turned into the direction toward the target until it reaches the wake again. Only then is the guidance gating circuit 38 opened again, and the sound detection system 11 is again able to guide the torpedo. The forced guidance thus prevents the torpedo from approaching a noise source which is not disposed in the wake.

FIG. 4 shows the drop-in-level signal S1 and the wake signal S3 during approach of the torpedo toward a noise source which is disposed in the wake. At time t1, the torpedo reaches the wake before it passes underneath the noise source at time t2. At time t2, the drop-in-level signal S1 appears and actuates the identification circuit 23 to check the signals in memory 19 for the presence of a wake and subsequently the minimum expanse of the noise source. If the identification circuit 23 does not detect a target, it emits a setting order S2 at output 86 to the turning course generator 32 at time t2. Since the torpedo 10 is in the wake (S3 is present), the setting order S2 is fed to the turning course generator 32 to reverse the torpedo 10 which has already crossed the path of the target. At time t3 the sound detection system 11 of the torpedo detects a new noise source (as indicated by the drop or disappearance of signal S1) and during its approach toward that new noise source, the torpedo 10 leaves the wake at time t5. Thus, at this time, the multivibrator circuit 82 in the guidance switch 36 (see FIG. 2) is switched and forced guidance begins to guide the torpedo in a turn back into the wake which the torpedo reaches at time t6 so that then the forced guidance is switched off.

FIGS. 3 and 4 show that the guidance switch 36 is switched when the torpedo leaves the wake again after having passed underneath a sound or noise source. With this measure the torpedo 10 is to be held in the wake and will approach only those noise sources which are disposed in the wake.

Figure 5:
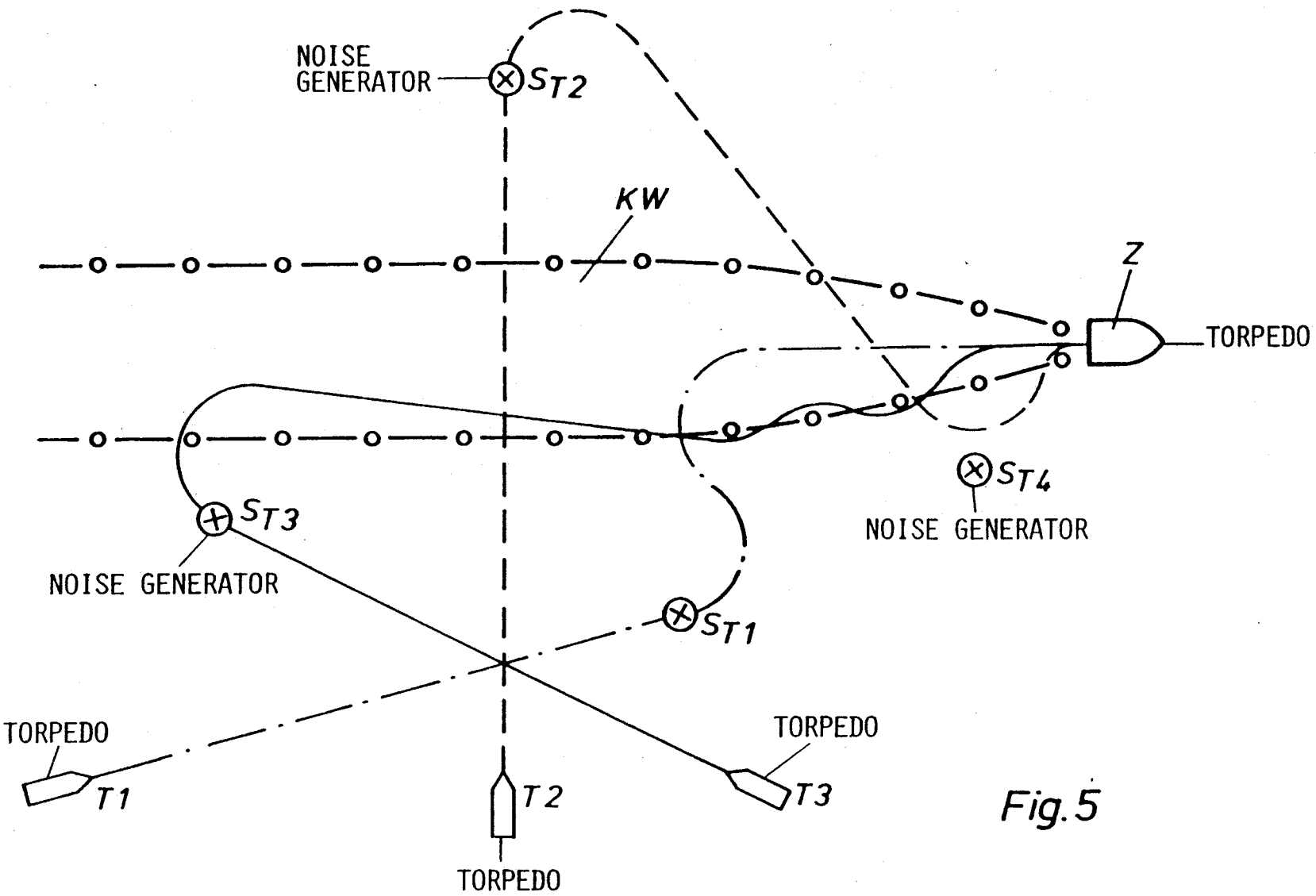
FIG. 5 is a schematic illustration of the approaches of three torpedoes toward a target with the use of a circuit arrangement according to the block circuit diagram of FIG. 1.

FIG. 5 is a schematic overview of typical approaches of three torpedoes T1 through T3 toward a target Z. For the sake of simplicity, the approaches are all shown in one scheme. Torpedoes T1 to T3 are guided in accordance with the method and apparatus of the invention as shown in FIGS. 1 through 4 with the use of an echo sounder which ranges toward the surface of the water and is able to detect echo signals from the wake and echo signals from a ship. This overview clarifies the mode of operation of the method according to the invention.

Due to its screw drive, target Z forms a wake Kw, which is formed of air bubbles and water whirls and is rather sharply defined in width. Target Z is protected against torpedo attacks by disturbance generators $S_{T1}$ to $S_{T4}$ which it drags behind. It is assumed that during approach of each one of the torpedoes T1 through T3 only one of the disturbance generators $S_{T1}$ to $S_{T3}$ is in use, i.e. disturbance generator $S_{T1}$ during the approach of torpedo T1, disturbance generator $S_{T2}$ during the approach of torpedo T2 and disturbance generator $S_{T3}$ during the approach of torpedo T3. It is further assumed that disturbance generator $S_{T4}$ is used only during the approach of torpedoes T2 and T3. The positions of disturbance generators $S_{T1}$ through $S_{T4}$ are shown at the respective moments at which a torpedo T1 through T3 arrives at the respective disturbance generator or passes underneath. Target Z is shown at the moment at which it is hit by torpedoes T1 through T3. The positions of target Z and of each individual disturbance generator $S_{T1}$ through $S_{T4}$ are thus shown with a mutual shift in time.

The topedoes initially approach the respectively loudest noise source, i.e. the respective disturbance generator. Torpedo T1, whose path is shown with the dash-dot line, approaches target Z from a rearward position, the second torpedo T2, whose path is shown by a dashed line, approaches the target Z from the side and a third torpedo T3, whose path is shown as a solid line, approaches target Z from a forward position. By approaching the respective disturbance generators, each torpedo is guided, according to the invention, into a rearward position in the vicinity of the target Z.

Torpedo T1 approaches disturbance generator $S_{T1}$ and does not detect a wake Kw on its path to this disturbance generator. When the torpedo passes underneath disturbance generator $S_{T1}$, the drop-in-level signal S1 appears which actuates the identification circuit 23, which emits the setting order S2 since no echo signals from the wake are stored in the echo memory 19. Since no wake was detected, the multivibrator stage 30 is not set, and the setting order S2 from the identification circuit 23 is switched to the search course generator 31. Torpedo T1 moves on a search course in an arc toward port and then in an arc toward starboard, during which is reaches the wake Kw. The search course toward starboard is interrupted as soon as the sound detection system 11 of torpedo T1 detects a further noise source, because then the drop-in-level signal S1 disappears and identification circuit 23 no longer emits a setting order S2. The sound detection system 11 of torpedo T1 guides the torpedo onto the target Z and the torpedo remains in the wake Kw during this time. In this case, it is not necessary to switch guidance switch 36. The described approach of torpedo T1 is an especially simple example.

The situation is different with torpedo T2 which crosses the wake Kw during approach to disturbance generator $S_{T2}$. When the torpedo initially reaches the wake Kw, its wake detector 28 detects the wake and multivibrator stage 30 is set and remains set during the entire approach, whether torpedo T2 happens to be in the wake Kw or not. Torpedo T2 passes underneath disturbance generator $S_{T2}$. There then appears the drop-in-level signal S1 which actuates the identification circuit 23. The identification circuit 23 determines that at that instant no echo signals from the wake are contained in echo memory 19 and emits the setting order S2. With the multivibrator stage 30 being set, the setting order S2 is fed to the turning course generator 32 which turns the torpedo T2 into the direction toward the target Z, i.e. in this case in the starboard direction.

The course of target Z is determined in approximation by the computer 48 of torpedo T2 during the approach of the torpedo to the disturbance generator $S_{T2}$ from the movement to the right of disturbance generator $S_{T2}$ as seen from torpedo T2. Therefore, in the illustrated example, the torpedo turns to the right, i.e. to starboard. The turn is completed as soon as the sound detection system 11 of torpedo T2 again detects a noise source, i.e. disturbance generator $S_{T4}$ in this example. During approach to disturbance generator $S_{T4}$ the torpedo T2 again crosses the wake Kw. At the moment when torpedo T2 leaves the wake Kw guided by the sound detection system 11, guidance switch 36 is switched. This is done as soon as the wake signal S3 drops off, after the drop-in-level signal S1 has dropped first as explained above.

The switching of the guidance switch 36 results in the identification circuit 23 being used only to detect the real target, and the setting order S2 is no longer used to actuate the search circuit 26. To guide the torpedo T2 it is merely necessary to use the turning course generator 32 to forcefully guide the torpedo back into the wake Kw. The guidance logic circuit 38 is used to separate the sound detection system 11 from the guidance device 12 of the torpedo T2 as soon as torpedo T2 is no longer in the wake Kw. The forced guidance becomes effective in guiding the torpedo T2 at the moment at which, during approach to disturbance generator $S_{T4}$, the torpedo leaves the wake Kw. The forced guidance guides the torpedo T2 by means of the turning course generator 32 back into the wake Kw. As soon as the wake Kw is reached, the sound detection system 11 becomes active again and guides torpedo T2 toward the target Z.

A third torpedo T3 initially reaches a disturbance generator $S_{T3}$ before reaching the wake Kw. After passing underneath disturbance generator $S_{T3}$, the identification circuit 23 emits a setting order S2 which, via the search generator 31, causes the torpedo T3 to perform a starboard search in the direction toward target Z. During this search, torpedo T3 reaches the wake Kw, but the search is terminated only after sound detecting system 11 of torpedo T3 has detected disturbance generator $S_{T4}$ and guides torpedo T3 toward it. During the approach to disturbance generator $S_{T4}$, computer circuit 48 determines approximate coincidence between the course of torpedo T3 and the course of target Z and emits the course signal Sk. Torpedo T3 with its two echo sounders 14, 15 and its two wake detectors 28, 52 is then directed toward that course. The course signal Sk interrupts the forced guidance by means of logic stage or circuit 41 so that the forced guidance now takes place by means of the logic stage or circuit 53 via the second course generator 60 in the search circuit 26.

If both wake detectors 28 and 52 indicate the presence of a wake, no forced guidance will take place, but if one of the two wake detectors 28, 52 does not indicate a wake, torpedo T3 is forcefully guided toward that side at which echo signals are still received from the wake. In the illustrated example, when torpedo T3 approaches disturbance generator $S_{T4}$ and leaves the wake Kw, only echo sounder 14 on the port side of torpedo T3 continues to receive echo signals from the wake Kw. At that time, guidance by the sound detection system 11 is interrupted and torpedo T3 is turned toward port by the forced guidance system until both echo sounders 14, 15 again receive echo signals from the wake Kw. Then, the sound detection system 11 is switched on again and again detects disturbance generator $S_{T4}$ when torpedo T3 again leaves the wake Kw on its starboard side, the guidance by sound detecting system 11 is again interrupted and torpedo T3 is again turned toward port, until both echo sounders 14, 15 again receive echo signals from the wake Kw. Thereafter, in the illustrated example, the sound detection system 11 of torpedo T3 detects the noise of the target Z and guides the torpedo T3 toward this target. By operating with two echo sounders 14, 15, torpedo T3 is guided back into the wake Kw much faster than is possible with the use of only one echo sounder because the torpedo can now be turned back into the wake Kw much sooner than if only a single echo sounder is used. This becomes particularly clear form the path of torpedo T2, because after it leaves the wake Kw in the direction toward disturbance source $S_{74}$, it must travel a much wider arc than torpedo T3 to get back into the wake Kw.

It will be understood that the above description of the present invention is susceptible to various modifications, changes and adaptations, and the same are intended to be comprehended within the meaning and range of equivalents of the appended claims.

What is claimed is:

1. A method for guiding an acoustic torpedo toward a ship which has been selected as a target, which constitutes a source of noise, and which, as a defense against torpedoes, may be dragging noise generating decoys (so-called disturbance generators) which constitute additional sources of noise, said method comprising the steps of: acoustically guiding the torpedo toward the noise source having the greatest noise level for the torpedo; checking for the presence of a wake upon approach of the torpedo to said noise source; after detection of a wake in the immediate vicinity of said noise source during passage of the torpedo underneath said noise source, checking said noise source for a minimum expanse in the vertical and travelling direction of the torpedo; and causing the torpedo to search for a further noise source if no wake is detected or if a wake is detected in the vicinity of said noise source but the minimum expanse is not detected.

2. A method as defined in claim 1 wherein said steps of checking for the presence of a wake and checking said noise source for a minimum expanse each include: causing the torpedo to emit sound pulses in the direction toward the surface of the water, receiving the reflected echo signals, and continuously evaluating said received echo signals as to the distance from the torpedo from which they were reflected; and wherein the presence of a wake is detected upon receipt of a predetermined number of successive echo signals from greatly divergent distances and the minimum expanse of said noise source is detected upon receipt of a predetermined number of successive echo signals from approximately the same and given distance.

3. A method as defined in claim 1 further comprising: as the torpedo approaches the noise source,determining the course of the noise source, and thus the approximate course of the target, from the bearing of the acoustic signals from the noise source received by the torpedo with respect to a path course given for the torpedo when it was fired; initiating said search for a further noise source in the direction of the determined course; terminating said search upon the acoustic detection of said further noise source; and thereafter again acoustically guiding the torpedo toward said further noise source.

4. A method as defined in claim 3 further comprising: turning the torpedo in the direction toward the target if, during said search for said further noise source, a wake is detected.

5. A method as defined in claim 3 further comprising: after acoustic detection of a further noise source and subsequent detection of a wake, replacing the acoustic guidance of the torpedo by forced guidance as soon and as long as the wake detection is missing; and performing said forced guidance such that the torpedo is turned in the direction toward the target and into the wake.

6. A method as defined in claim 5 wherein: said step of checking for the presence of a wake includes emitting sound pulses from both sides of the torpedo obliquely toward the surface of the water and symmetrically with respect to the longitudinal axis of the torpedo, and separately evaluating the received echo signals for each sound beam direction to determine the presence of a wake; said step of replacing the acoustic guidance includes actuating the forced guidance as soon as no wake detection is made in one of the two sound directions; and said step of performing the forced guidance includes the turning of the torpedo during the forced guidance toward that side of the torpedo from whose sound beam direction a wake is detected.

7. In an acoustic torpedo including a guidance device for determining the direction of travel of the torpedo, and a sound detection system for receiving acoustic signals emanating from a noise source and for providing guidance signals, at a guidance output, for controlling the guidance device to guide the torpedo toward a detected noise source, the improvement wherein apparatus is provided for guiding the torpedo toward a ship selected as a target which, as a defense against torpedoes, may be dragging generating decoys, said apparatus comprising in combination: amplitude measuring means, having its input connected to the receiver output of said sound detection system, and for producing an output signal whenever the signals received by the sound detection system from a noise source being approached exhibit a sudden drop-in-level and for maintaining this output signal as long as the signals received by the sound detection system do not again exceed a given threshold value; a detection circuit means for continuously monitoring for the detection of a target wake during travel of the torpedo and for checking an approached noise source for a predetermined minimum vertical and horizontal expanse, said detection circuit means including an identification circuit means, which has its control input connected to the output of said amplitude measuring means, for producing a firing order output signal at a first of its two outputs whenever, before the occurrence of drop-in-level output signal from said amplitude measuring means, a wake has been detected and, after the occurrence of said drop-in-level signal, a minimum expanse for a noise source has been detected, and for otherwise producing a setting order output signal at the second of its two outputs for the duration of said drop-in-level output signal; and further circuit means, responsive to an output signal at said second output of said identification circuit means, for selectively causing said torpedo to initiate a search run for a further noise source.

8. Apparatus as defined in claim 7 wherein said detection circuit means includes: at least one echo sounder having a sound transmitter and an echo receiver which are oriented to have their respective transmitting or receiving direction essentially toward the surface of the water; and at least one echo memory having its input connected to the output of said echo receiver and its output connected to the signal input of said identification circuit means so as to enable said identification circuit means to check the echo signals stored in said echo memory for the presence of echo signals indicating a wake and said minimum expanse.

9. Apparatus as defined in claim 8 wherein said further circuit means includes a search circuit whose input is connected, via a guidance signal generator, with said second output of said identification circuit means and those output is connected with said guidance device of the torpedo.

10. Apparatus as defined in claim 9 wherein: said guidance signal generator includes circuit means for selectively gating the output signal at said second output of said identification circuit means to a first or a second output of said guidance signal generator; said search circuit includes a search course generator and a turning course generator whose inputs are connected with said first and second outputs, respectively, of said guidance signal generator and whose outputs are connected to said output of said search circuit; and further comprising a computer circuit means, having a first input connected with said guidance output of said sound detection system and a second input connected with an input device for a path curve for the torpedo, for determining the course of the approached noise source, said computer circuit means having its output connected with the control inputs of said search course generator and said turning course generator.

11. Apparatus as defined in claim 10 wherein said circuit means included in said guidance signal generator for selectively gating includes: wake detector means, connected with said output of said echo memory for emitting a wake signal when the echo signals in said echo memory indicate the presence of a wake; a bistable multivibrator stage connected to the output of said wake detector means so as to be set by said wake signal; and logic circuit means, having two logic stages which each have a first input connected with said second output of said identification circuit means, a second input connected to the output of said multivibrator stage, and an output connected with a respective one of said first and second outputs of said guidance signal generator, for gating a setting order output signal at said second output of said identification circuit means to said search course generator via said first output of said guidance signal generator if said multivibrator stage is not set.

12. Apparatus as defined in claim 11 wherein said guidance signal generator further includes: a guidance switching means having first and second outputs and having inputs connected to said output of said amplitude measuring means and to said output of said wake detector means, respectively, said guidance switching means normally producing an output signal at only its said first output and switching and producing an output signal at only its said second output when, after receipt of a drop-in-level output signal from said amplitude measuring means and a wake signal from said wake detector means, and after the subsequent disappearance of said drop-in-level output signal, the wake signal from said wake detector means disappears for the first time; a third output for said guidance signal generator connected to said first output of said guidance switching means; logic circuit means, connected between said second output of said identification circuit means and said first input of each of said two logic stages, for blocking said setting order output signal in response to an output signal from said second output of said guidance switching means; and a further logic circuit means having a signal input connected to said output of said wake detector means, a control input connected to said second output of said guidance switching means and outputs connected to said second and said third outputs of said guidance signal generator, said further logic circuit means producing an output signal at said third output of said guidance signal generator in response to an input signal at both of its said signal and control inputs,and producing an output signal at said second output of said guidance signal generator in response to an input signal at its said control input and no input signal at its said signal input; and wherein said further circuit means includes a guidance gating circuit having a gating input connected to said third output of said guidance signal generator, said guidance gating circuit being connected between said guidance output of said sound detecting system and said guidance device of the torpedo, whereby the guidance signals from said sound detecting system are gated to said guidance device upon the presence of an output signal at said third output of said guidance signal generator.

13. Apparatus as defined in claim 12 wherein: said detection circuit means further includes a second echo sounder having a further sound transmitter and a further echo receiver, with said sound transmitter and echo receiver of said one echo sounder being disposed on the port side of the torpedo and said further sound transmitter and said further echo receiver being symmetrically disposed on the starboard side of the torpedo, and a further echo memory having its input connected to the output of said further echo receiver; said guidance signal generator includes a further wake detector means having an input connected to the output of said further echo memory, and having an output, and another logic circuit means having signal inputs connected with said outputs of both of said wake detector means, control inputs connected respectively to said second output of said guidance switching means and to a further output of said computer circuit means at which a course signal is present if and as long as the torpedo essentially follows the course of the target, and first, second and third outputs connected respectively to said third output of said guidance signal generator and to fourth and fifth outputs of said guidance signal generator, said another logic circuit means (a) produces a gating output signal at said third output of said guidance signal generator when input signals are present at all of its said signal and control inputs, (b) produces an output signal at said fourth output of said guidance signal generator whenever signals are present at both of its said control inputs, at its said signal input connected to said output of said further wake detector means and not at said output of the other of said wake detector means,and (c) produces an output signal at said fifth output of said guidance signal generator whenever signals are present at both of its said control inputs, at its said signal input connected to said output of said other of said wake detector means and not at said output of said further wake detector means; and said search circuit further includes a course generator means having first and second inputs connected respectively to said fourth and fifth outputs of said guidance signal generator and an output connected to said output of said signal generator, said course generator means being responsive to an input signal at its said first input for producing an output signal which actuates said guidance device to turn the torpedo to starboard and being responsive to an input signal at its said second input for producing an output signal which actuates said guidance device to turn the torpedo to port.

* * * * *